US008281953B2

(12) United States Patent
Yourist

(10) Patent No.: US 8,281,953 B2
(45) Date of Patent: Oct. 9, 2012

(54) REINFORCED PLASTIC CONTAINERS

(75) Inventor: Sheldon E. Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 12/941,334

(22) Filed: Nov. 8, 2010

(65) Prior Publication Data

US 2011/0226788 A1 Sep. 22, 2011

Related U.S. Application Data

(63) Continuation-in-part of application No. 12/727,932, filed on Mar. 19, 2010.

(51) Int. Cl.
*B65D 8/00* (2006.01)
*B65D 90/02* (2006.01)

(52) U.S. Cl. ..... 220/669; 220/675

(58) Field of Classification Search ..... 220/604, 220/669, 672, 675; 215/382, 383
See application file for complete search history.

(56) References Cited

U.S. PATENT DOCUMENTS

| | | | | |
|---|---|---|---|---|
| D200,443 | S | 2/1965 | Deegan | |
| D201,400 | S | 6/1965 | Kneeland | |
| D205,686 | S | 9/1966 | Marchant | |
| 3,357,593 | A | 12/1967 | Sears, Jr et al. | |
| D277,041 | S | 1/1985 | Nichols | |
| 4,840,289 | A | 6/1989 | Fait et al. | |
| 4,997,691 | A | 3/1991 | Parkinson | |
| 5,054,632 | A * | 10/1991 | Alberghini et al. | 215/381 |
| 5,071,029 | A | 12/1991 | Umlah et al. | |
| D323,290 | S | 1/1992 | Keedy, Jr. | |
| D324,493 | S | 3/1992 | Nickerson | |
| 5,217,737 | A * | 6/1993 | Gygax et al. | 426/111 |
| 5,718,352 | A | 2/1998 | Diekhoff | |
| 6,095,360 | A * | 8/2000 | Shmagin et al. | 215/382 |
| 6,520,362 | B2 | 2/2003 | Heisel et al. | |
| D559,120 | S | 1/2008 | Farrow et al. | |
| D559,121 | S | 1/2008 | Farrow et al. | |
| 2004/0149677 | A1 | 8/2004 | Slatt et al. | |
| 2004/0211746 | A1 | 10/2004 | Trude et al. | |
| 2009/0166314 | A1 | 7/2009 | Matsuoka | |

FOREIGN PATENT DOCUMENTS

| | | | |
|---|---|---|---|
| GB | 2161133 | A * | 1/1986 |
| WO | 02074635 | A1 | 9/2002 |

OTHER PUBLICATIONS

International Search Report for International Application No. PCT/US2011/029014 dated Aug. 22, 2011.

* cited by examiner

*Primary Examiner* — Harry Grosso
(74) *Attorney, Agent, or Firm* — The Patentwise Group, LLC

(57) ABSTRACT

A plastic container includes a bottom portion and a main body portion having a plastic sidewall that is connected to the bottom portion. The main body portion has a reinforced sidewall area that comprises a plurality of first sidewall portions and a plurality of second sidewall portions that are respectively interposed between the first sidewall portions. Each of the second sidewall portions is shaped to define a plurality of circumferentially spaced structures that are selected from the group consisting of indentations and projections. The second sidewall portions may include a plurality of circumferentially spaced vertical columns, and adjacent second sidewall portions that are rotationally staggered with respect to each other so that the vertical columns on one second sidewall portion are not aligned with the vertical columns of an adjacent second sidewall portion.

44 Claims, 7 Drawing Sheets

REINFORCED PLASTIC CONTAINERS

This is a continuation-in-part of application Ser. No. 12/727,932, filed Mar. 19, 2010, the entire disclosure of which is hereby incorporated by reference as if set forth fully herein.

BACKGROUND OF THE INVENTION

1. Field of the Invention

This invention relates generally to the field of packaging, and more specifically to the field of plastic containers, such as those plastic containers that have size, shape and functionality that permits them to serve as a replacement for conventional metal cans.

2. Description of the Related Technology

The use of metal cans to package products such as foodstuffs is well over a century old. Conventional metal cans are either of a two-piece configuration, in which a lid is secured to a can body having an integral bottom portion using a double seaming process, or of a three-piece configuration in which a lid and a bottom member are respectively secured to opposite open ends of a substantially cylindrical can body.

Plastic cans have been proposed as a substitute for conventional metal cans, but to date they have not achieved any significant commercial success. The use of plastic to fabricate a can body offers a number of potential advantages, such as lower energy costs during both the manufacturing and recycling stages, better formability and less susceptibility to denting during handling. Dented metal cans present potential health risks, such as increased susceptibility to contamination that can lead to conditions such as botulism.

In addition, a can that is fabricated out of food grade plastic would not require potentially harmful coatings of such materials as Bisphenol A (BPA). However, plastic lacks the inherent strength of metals such as steel and aluminum. It also tends to soften at much lower temperatures than steel and aluminum.

Plastic containers such as plastic cans accordingly may lack the column strength that is necessary to avoid deformation of the sidewall of the container when a number of containers or palettes of containers are stacked during transportation or in packaging or retail facilities. While it is possible to increase the strength of a plastic container by increasing the thickness of the sidewall, doing so also increases manufacturing costs by increasing the amount of plastic material that is required. Lightweighting is an important consideration in the design of plastic containers, including plastic cans, because plastic material tends to be relatively expensive.

Many plastic containers such as plastic cans also typically lack the requisite circumferential or hoop strength that is required to avoid excessive deformation when the contents of the container becomes pressurized. Certain products, particularly food, require sterilization during the packaging process in order to inhibit the growth of bacteria.

The most common commercial procedure for heat sterilizing canned foods is a retort process in which filled but unsterilized sealed cans are placed in a retort chamber that is injected with steam and held at a predetermined elevated temperature (typically between about 210° F. to about 260° F.) for a predetermined period of time. Conventional plastic cans have been considered unsuitable for packaging applications in which heat sterilization is required, because the heat and pressurization that is inherent to such processes has the tendency to cause irreversible damage and deformation to the sidewall of the plastic can. Positive pressurization is typically developed within the container during the retort process as a result of the expansion that occurs when the contents of the container are heated. As the container cools after the retort process, negative pressurization can also be an issue, particularly in instances where there is a large amount of headspace within the container.

Metal cans are also commonly used to package pressurized beverages such as beer and soft drinks. In addition, other beverages that are not carbonated may develop a positive pressure with respect to ambient atmospheric conditions when the container is heated or transported to higher altitudes. Conventional extrusion blow molded plastic cans have been considered unsuitable for use in the packaging of such beverages.

A need exists for a plastic container that has sufficient column strength and hoop strength to replace a conventional metal can, and that has sufficient rigidity and stability under elevated pressures and temperatures to permit heat sterilization without experiencing excessive deformation. A need further exists for a plastic container that has sufficient strength to resist internal pressurization, so that it could be used to package carbonated beverages and the like. Moreover, a need exists for a plastic container that has sufficient strength to resist negative pressurization that may develop within the container after heat sterilization. In addition, a need exists for a method of producing a heat sterilized packaged product that utilizes a plastic container.

SUMMARY OF THE INVENTION

Accordingly, it is an object of the invention to provide a plastic container that has sufficient column strength and hoop strength to replace a conventional metal can, and that has sufficient rigidity and stability under elevated pressures and temperatures to permit heat sterilization without experiencing excessive deformation.

It is further an object of the invention to provide a plastic container that has sufficient strength to resist internal pressurization, so that it can be used to package carbonated beverages and the like.

Moreover, it is an object of the invention to provide a plastic container that has sufficient strength to resist negative pressurization that may develop within the container after heat sterilization.

It is yet further an object of the invention to provide a method for producing a heat sterilized packaged product that utilizes a plastic container.

In order to achieve the above and other objects of the invention, a plastic container according to a first aspect of the invention includes a bottom portion and a main body portion having a plastic sidewall that is connected to the bottom portion. The main body portion has a reinforced sidewall area that comprises a plurality of first sidewall portions and a plurality of second sidewall portions that are respectively interposed between the first sidewall portions. Each of the second sidewall portions is shaped to define a plurality of circumferentially spaced structures that are selected from the group consisting of indentations and projections.

A plastic container according to a second aspect of the invention includes a bottom portion and a main body portion having a plastic sidewall that is connected to the bottom portion. The sidewall includes a plurality of circumferentially extending first sidewall portions and a plurality of circumferentially extending second sidewall portions. Each of the second sidewall portions is interposed between two adjacent first sidewall portions. Moreover, each of the second sidewall portions includes a plurality of circumferentially spaced vertical columns, and adjacent second sidewall portions are rotationally staggered with respect to each other so that the vertical columns on one second sidewall portion are not aligned with the vertical columns of an adjacent second sidewall portion.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
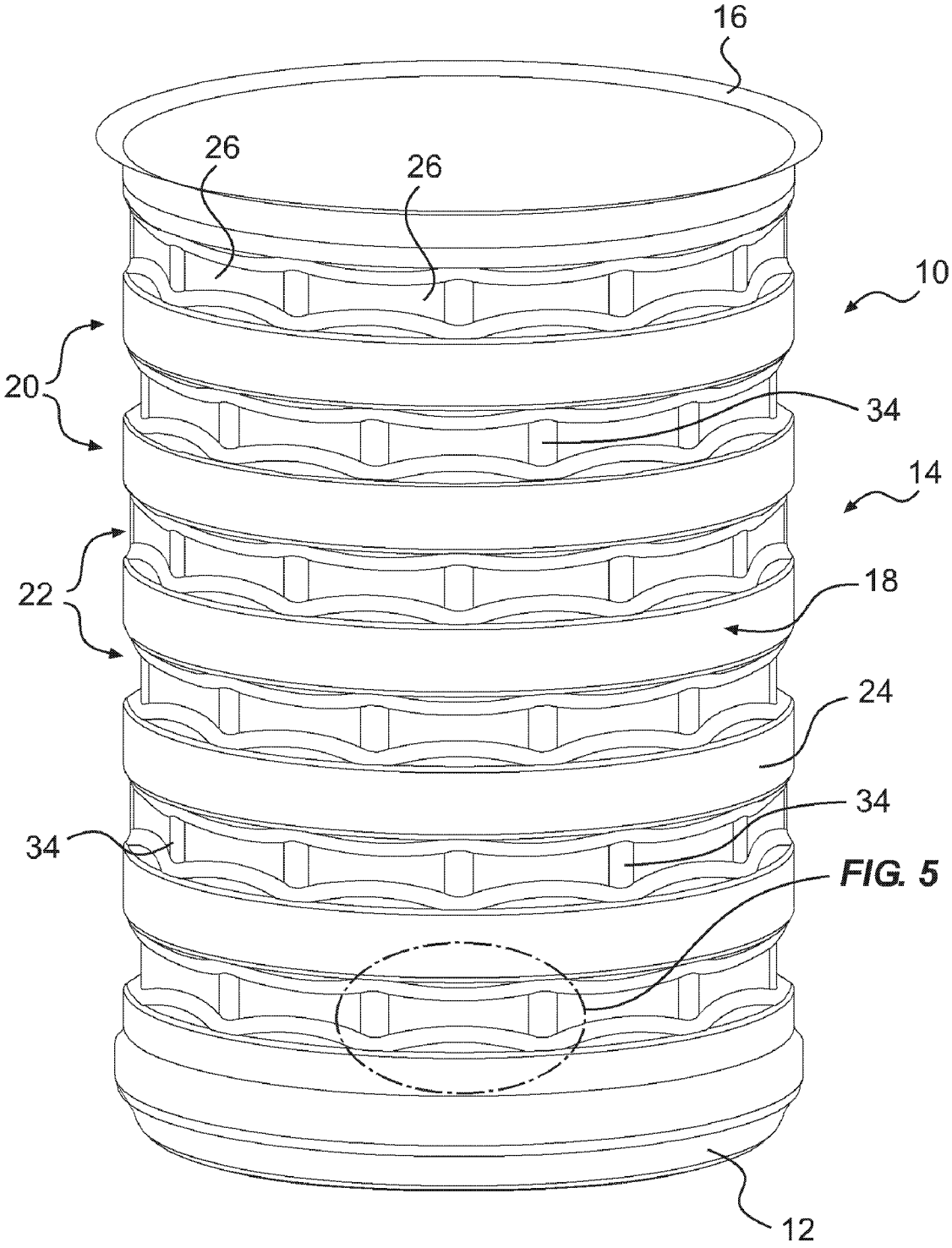
FIG. 1 is a perspective view of a plastic can body that is constructed according to a preferred embodiment of the invention.

Referring now to the drawings, wherein like reference numerals designate corresponding structure throughout the views, and referring in particular to FIG. 1, a plastic can body 10 that is constructed according to a preferred embodiment of the invention is preferably fabricated from a food grade plastic material such as polyolefin, polypropylene, polyethylene or high-density polyethylene using a conventional extrusion blow molding process. The most preferred construction of the plastic portion of the plastic can body 10 is discussed in greater detail below.

Alternatively, plastic can body 10 may be fabricated from a material such as polyethylene terephthalate (PET) using a conventional reheat stretch blow molding process.

Figure 2:
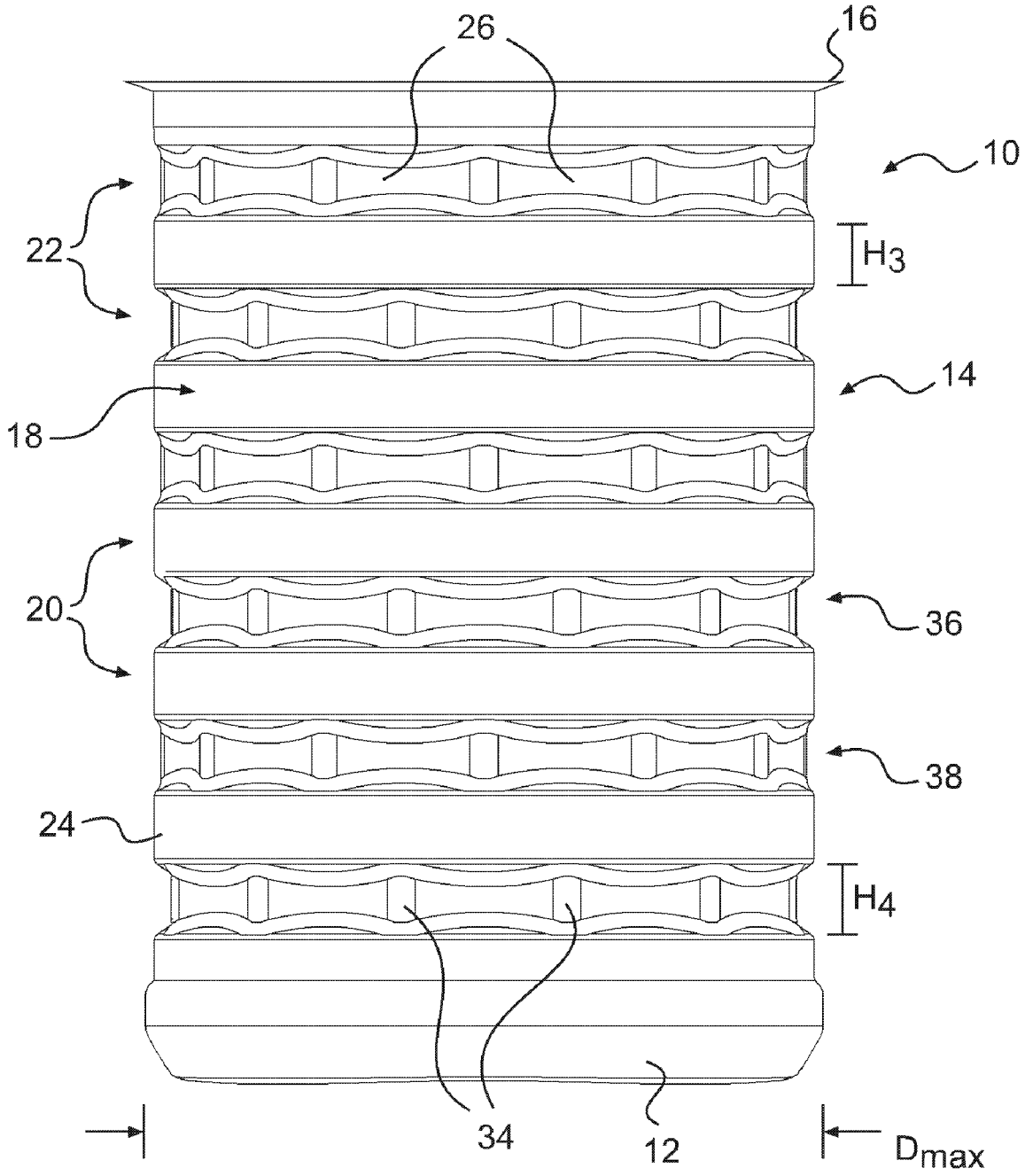
FIG. 2 is a side elevational view of the plastic can body that is shown in FIG. 1.

As is best shown in FIGS. 1 and 2, plastic can body 10 preferably includes a bottom portion 12 and a main body portion 14 having a plastic sidewall 16 that is connected to the bottom portion 12. The main body portion 14 preferably defined an upper rim 16 that is adapted to be secured to a lid member 30, as is diagrammatically shown in FIG. 3.

The lid member 30 is preferably fabricated from a metallic material such as steel, but it alternatively could be fabricated from a plastic material or any other suitable material. The lid member 30 is preferably secured to the upper rim 16 using a standard double seaming process of the type that is used to seal metal cans. Alternatively, the lid member 30 could be welded or otherwise secured to the upper rim 16.

In the preferred embodiment, the bottom portion 12 is integral with the plastic sidewall 16 and is also fabricated from a plastic material. Alternatively, the plastic can body 10 could be made for a three-piece can construction, in which the can body 10 is constructed as an open tube having a bottom rim that is similar to the upper rim 16, and a bottom lid could be secured in the manner described above with reference to the lid member 30.

As is best shown in FIGS. 1 and 2, the sidewall 18 is preferably constructed to define a plurality of first sidewall portions 20 and a plurality of second sidewall portions 22, each of which is interposed between two adjacent of the first sidewall portions 20. The first sidewall portions 20 are each preferably constructed so that they have substantially flat circumferentially extending outer surface 24, which in the preferred embodiment extends about an entire circumference of the main body portion 14.

The substantially flat circumferentially extending outer surfaces 24 are preferably oriented so that they are substantially vertical as viewed in side elevation, as shown in FIG. 2. In other words, they are preferably positioned to substantially reside within a plane that is parallel to a longitudinal axis 28 of the main body portion 14.

Alternatively, the outer circumferential surface of the first sidewall portions 20 could be convexly or concavely curved, or it could have a more complex shape.

Figure 3:
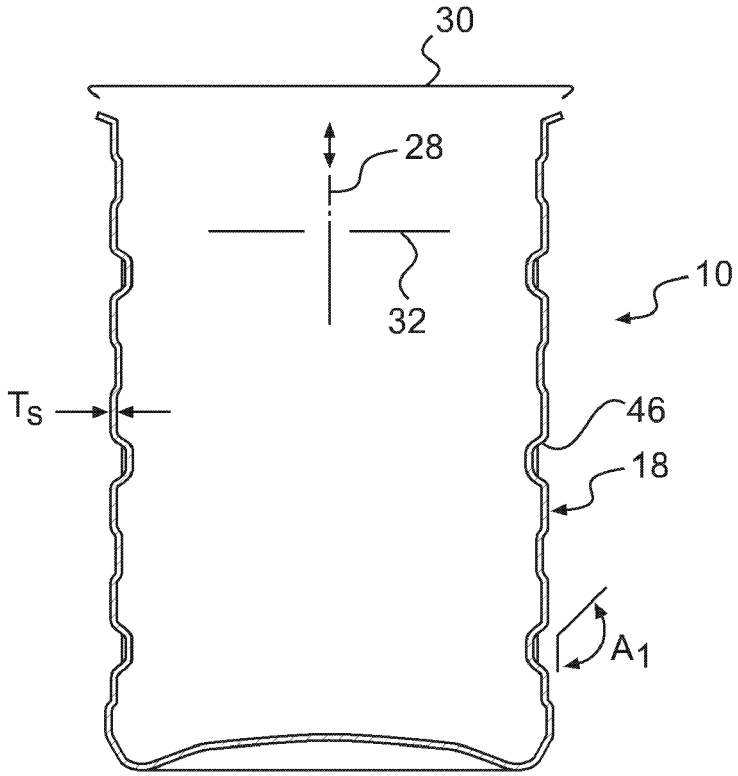
FIG. 3 is a diagrammatical longitudinal cross-section depicting the plastic can body that is shown in FIG. 1.

In addition, each of the substantially flat circumferentially extending outer surfaces 24 preferably intersect a horizontal plane 32 that is perpendicular to the longitudinal axis 28 of the main body portion 14, as is shown diagrammatically in FIG. 3.

The main body portion 14 is preferably substantially cylindrical in shape, but it could alternatively be constructed of anyone of a plurality of possible alternative shapes, including a tapered shape or a complex shape according to the preferences of a packaging customer. The use of the plastic material in the sidewall 18 facilitates the fabrication of complex shapes that are difficult or impossible to achieve using a metal can body. Preferably, but not necessarily, the main body portion is shaped so that it is substantially symmetrical about the longitudinal axis 28.

Each of the second sidewall portions 22 is preferably shaped to define a plurality of circumferentially spaced indentations 26. Each of the second sidewall portions 22 preferably extend about an entire circumference of the main body portion 14. The circumferentially spaced indentations 26 are preferably spaced substantially evenly about the entire circumference of the main body portion 14. Preferably, although not necessarily, there are an even number of the circumferentially spaced indentations 26 within each of the second sidewall portions 22.

In the illustrated embodiment, there are twelve of the indentations 26 defined within each of the second sidewall portions 22. Preferably, the number of indentations within each of the second sidewall portions 22 is within a range of about four to about fifty, and more preferably within a range of about eight to about twenty-four.

Referring again to FIGS. 1 and 2, it will be seen that each of the second sidewall portions 22 further includes a plurality of substantially vertical columns or beams 34, with each of the vertical columns or beams 34 being interposed between two adjacent ones of the circumferentially spaced indentations 26. The substantially vertical columns or beams 34 have the effect of providing additional column strength to the main body portion 14.

Figure 4:
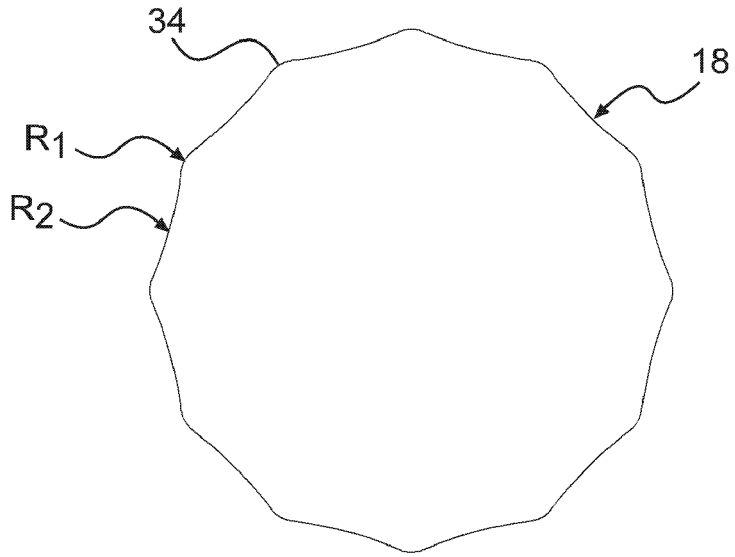
FIG. 4 is a diagrammatical transverse cross-section depicting the plastic can body that is shown in FIG. 1.

Each of the substantially vertical columns 34 preferably has an outer surface that is convexly curved as viewed in transverse cross-section, as is shown diagrammatically in FIG. 4. The plastic can body 10 has a maximum diameter $D_{MAX}$ that is depicted in FIG. 2, which is preferably substantially within a range of about 40 mm to about 250 mm, more preferably within a range of about 45 mm to about 150 mm and most preferably within a range of about 55 mm to about 100 mm.

In the preferred embodiment, the convex curvature of the outer surface of the substantially vertical columns 34 is a substantially constant radius, but alternatively a nonconstant radius could be used. Preferably, a ratio of the average radius $R_1$ of the outer surface of the substantially vertical columns 34 to the maximum diameter $D_{MAX}$ is substantially within a range of about 0.0195 to about 0.15, and more preferably substantially within a range about 0.03 to about 0.075.

As is diagrammatically shown in FIG. 4, each of the indentations 26 preferably has an average concave radius of curvature $R_2$. In the preferred embodiment, the curvature is a substantially constant radius, but a nonconstant radius could alternatively be employed. Preferably, a ratio of the radius of curvature $R_2$ to the maximum outer diameter $D_{MAX}$ is substantially within a range of about 0.25 to about 1.5, and more preferably substantially within a range of about 0.5 to about 1.0.

FIG. 2 shows two adjacent second sidewall portions 22, indicated with reference numerals 36, 38. In the preferred embodiment, adjacent second sidewall portions 36, 38 are rotationally staggered with respect to each other so that the substantially vertical columns 34 within the respective adjacent second sidewall portions 36, 38 are not aligned with each other. More preferably, the adjacent second sidewall portions 36, 38 are staggered or rotationally displaced with respect to each other so that each of the vertical columns 34 is substantially centered with respect to one of the indentations 26 in the adjacent second sidewall portion.

The staggering of the vertical columns 34 maintains the high column strength that is imparted by the columns 34, while increasing the overall hoop and shear strengths of the main body portion 14.

Figure 5:
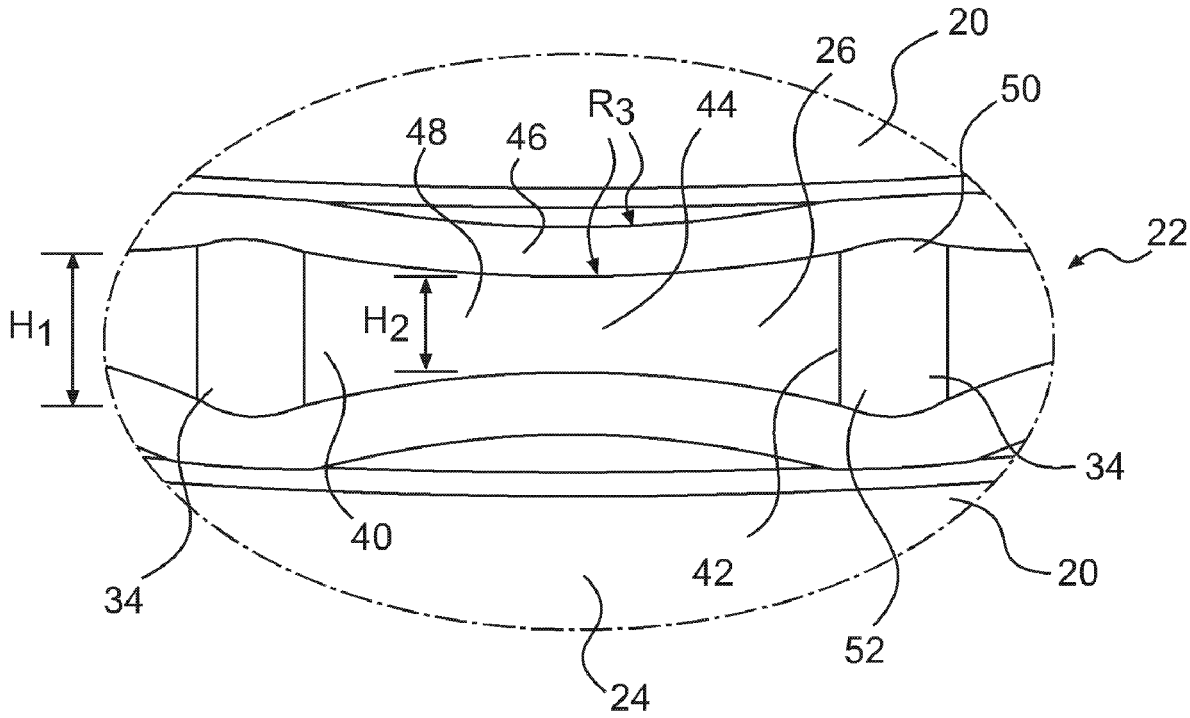
FIG. 5 is an enlarged view of one portion of the plastic can body that is shown in FIG. 2.

FIG. 5 provides an enlarged view of one of the indentations 26 along with the surrounding structure. In the preferred embodiment, each of the indentations 26 has a horizontally oriented hourglass shape having a first side 40 that has a first vertical height, a second side 42 that has a second vertical height and a central portion 44 that has a minimum height $H_2$ that is preferably less than either of said first or second vertical heights. In the preferred embodiment, the first and second vertical heights are substantially equal to each other and are represented by the value $H_1$. A ratio $H_1/H_2$ is preferably substantially within a range of about 1.1 to about 2.0, and more preferably substantially within a range of about 1.25 to about 1.75.

In the preferred embodiment, a fillet 46 is defined between each of outer surfaces 24 of the adjacent first sidewall portions 20 and the floor 48 of each of the indentations 26. As FIG. 5 shows, each of the vertical columns 34 have a first end 50 that is joined to one of the fillets 46 and a second end 52 that is joined to another of the fillets 46. Each of the fillets 46 is concave as viewed in side elevation and has a radius $R_3$ that in the preferred embodiment is substantially constant. Preferably, a ratio of the radius $R_3$ to the maximum outer diameter $D_{MAX}$ of the plastic can body 10 is substantially within a range of about 0.01 to about 0.05 and more preferably substantially within a range of about 0.02 to about 0.04.

The second ends 52 of the vertical columns 34 on each side of the indentation 26 together with the first end 50 of the vertical column 34 that is centered with respect to the indentation 26 within the adjacent underlying second sidewall portion 22 together define a triangular shape that, in aggregate with the other triangular shapes that are likewise defined on the sidewall 18 creates an intermeshed complex force transmission structure that optimizes the column strength, the hoop strength and shear strength of the sidewall 18 and the main body portion 14.

Moreover, the complex curvature that is created by the fillets 46, the vertical columns 34 and the outer surfaces 24 of the adjacent first sidewall portions 20 provide structural reinforcement longitudinally, circumferentially and diagonally throughout the extent of the sidewall 18.

Each of the fillets 46 is preferably angled with respect to the longitudinal axis 28 at an angle $A_1$ that is preferably substantially within a range of about 114° to about 134°, and more preferably substantially within a range of about 119° to about 129°.

At least one of the first sidewall portions 20 has a first vertical height $H_3$, and at least one of the second sidewall portions 22 has a second vertical height $H_4$. In the preferred embodiment, all of the first sidewall portions 20 are of the same vertical height $H_3$, and all of the second sidewall portions 22 are of the same vertical height $H_4$. A ratio $H_3/H_4$ of the first vertical height to the second vertical height is preferably substantially within a range of about 0.20 to about 5.0, and more preferably substantially within a range of about 0.50 to about 2.0.

In an alternative embodiment, the structure of the sidewall 18 that is described above could be inverted so that the indentations 26 are protrusions and the vertical columns 34 are concave and extend inwardly rather than being convex.

In another alternative embodiment, the first and second sidewall portions 20, 22 could have a helical construction that would extend through the entire length of the sidewall 18 so that the sidewall 18. For purposes of this document, such an embodiment would be considered to have a plurality of first sidewall portions and a plurality of second sidewall portions, since parts of both of the first and second sidewall portions would be longitudinally displaced from each other.

Figure 6:
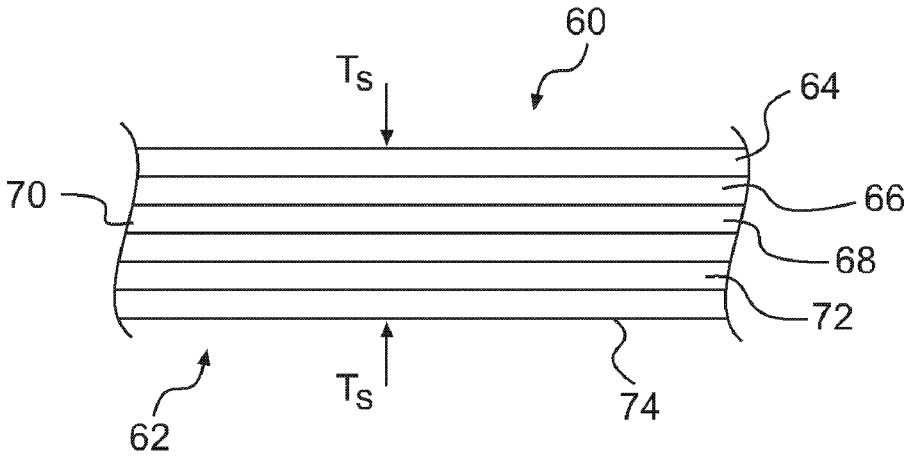
FIG. 6 is a diagrammatical depiction of a preferred multilayer material that is used in a sidewall of the plastic can body that is depicted in FIG. 1.

Preferably, the sidewall 18 is fabricated from an extruded multilayer material, shown diagrammatically in FIG. 6, using a conventional extrusion blow molding process in which a hollow parison of multiplayer plastic material is continuously extruded, and a moving mold captures a portion of the parison, which is subsequently internally inflated against the inner surfaces of the mold to shape and size the contours of the plastic can body 10, which is removed from the mold and trimmed.

In the most preferred embodiment, the outer surface 60 of the sidewall 18 is defined by a first layer 64 of plastic material, which is fabricated from a food grade polypropylene. A second adhesive layer 66 attaches the first layer 64 to a third layer 68, which is preferably fabricated from ethylene vinyl acetate (EVOH). A fourth layer 70 of adhesive secures the third layer 68 to a fifth layer 72 of regrind polypropylene material. A sixth, inner layer 70 of a virgin polypropylene material is blended with the fifth layer 72.

The sidewall 18 is preferably shaped to have a substantially constant thickness $T_S$, as is shown diagrammatically in FIG. 3, that is preferably substantially within a range of about 0.040 inch to about 0.065 inch for applications requiring heat sterilization, and more preferably substantially within a range of about 0.045 inch to about 0.055 inch. For other packaging applications in which heat sterilization is not anticipated, the thickness $T_S$ is preferably substantially within a range of about 0.015 inch to about 0.065 inch, and more preferably substantially within a range about 0.020 inch to about 0.055 inch.

Figure 7:
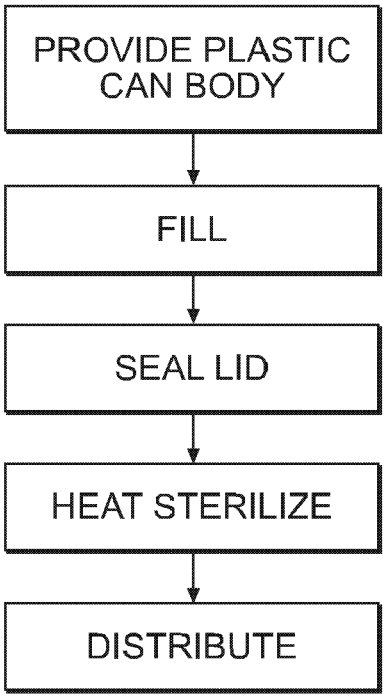
FIG. 7 is a flowchart depicting a method that is performed according to a preferred embodiment of the invention.

A method of providing a heat sterilized package product according to a preferred embodiment of the invention is depicted in FIG. 7 and would utilize the plastic can body 10 described above. The plastic can body 10 would be filled with a product, which could be a food or a beverage, and the lid 30 would be secured to the upper rim of the plastic can body 10 using a process such as the double-seaming process in order to seal the product within the closed container.

The lid 30 could be fabricated from a metallic material such as steel or aluminum, from a plastic material, or be of a composite design that includes both metallic material and plastic material. For example, the lid 30 could be fabricated from a plastic material that has a metallic insert with a tamper evident button that is designed to pop outwardly when the lid 30 is first removed from the container. The lid 30 could also be embodied as a foil closure that is induction sealed to the upper rim of the plastic can body 10. Such closures are commercially available from Bapco Closures of Surrey, United Kingdom.

The closed container would then be subjected to a heat sterilization process such as a retort process in which the closed container is exposed to heated steam at temperatures of about 210° F. to about 260° F. for a predetermined period of time that is sufficient to kill any bacteria that may be within the closed container. The unique construction of the plastic can body 10 ensures that it will be able to survive such a heat sterilization process with a minimum of deformation and without being breached. The closed container is then commercially distributed to consumers.

Figure 8:
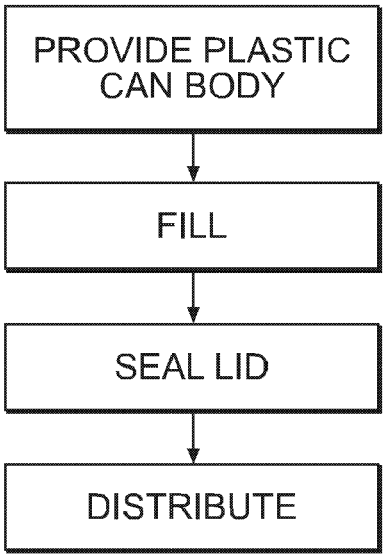
FIG. 8 is a flowchart depicting a method that is performed according to an alternative embodiment of the invention.

A method of packaging materials that are expected to undergo internal pressurization, such as carbonated beverages, according to another embodiment of the invention is depicted in FIG. 8 and would also utilize the plastic can body 10 that is described above. The plastic can body 10 would be filled with a product such as a carbonated beverage and the lid 30 as it is described above would be secured to the upper rim of the plastic can body 10 using a process such as the double-seaming process in order to seal the product within the closed container.

In this and other embodiments, the lid 30 could be an easy open lid that may be opened by a consumer without needing an additional tool such as a can opener. After filling and sealing, the product would be commercially distributed to consumers. The unique construction of the plastic can body 10 will ensure that any deformation as a result of internal pressurization will not be excessive.

Figure 9:
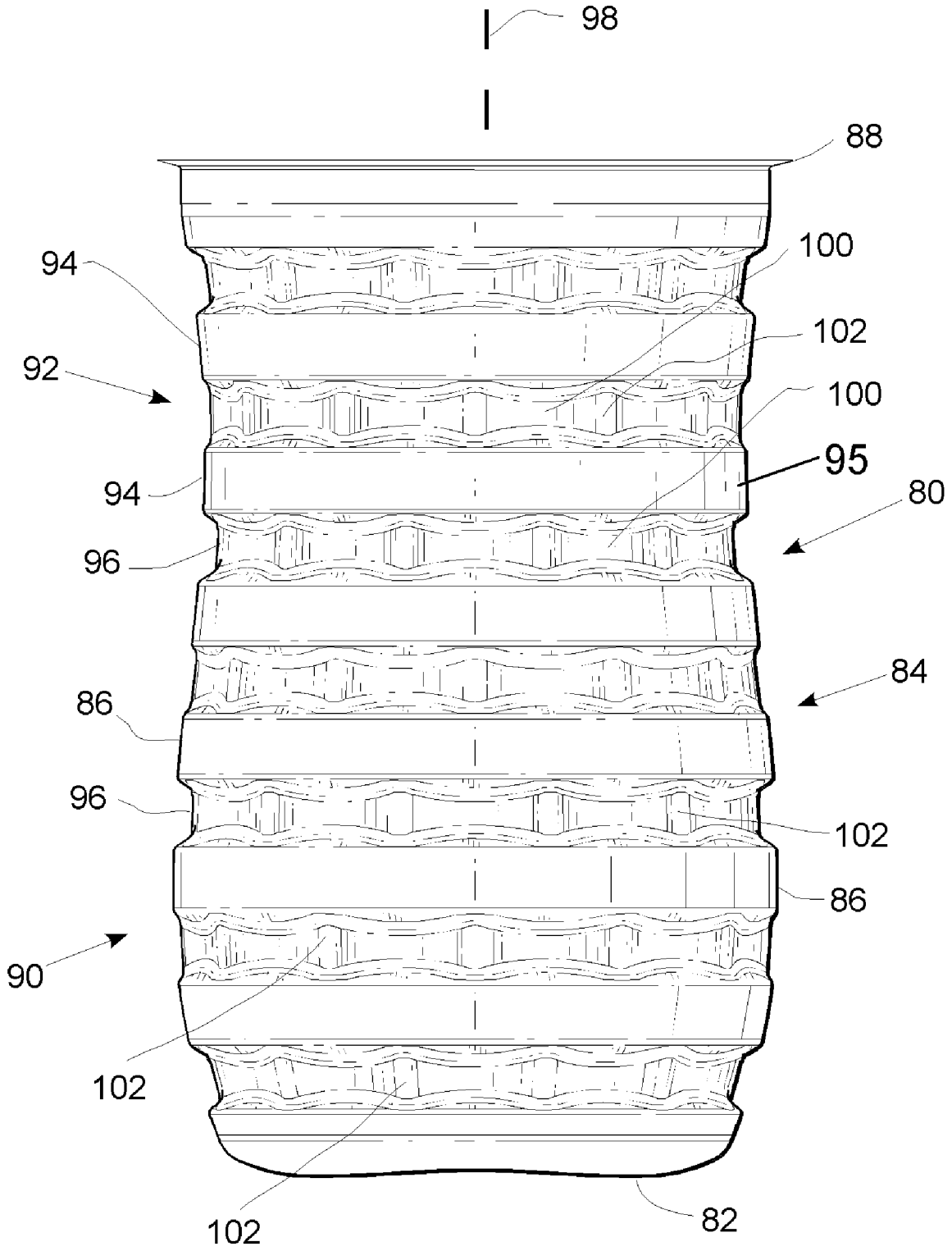
FIG. 9 is a side elevational view depicting a plastic container that is constructed according to an alternative embodiment of the invention.

Referring now to FIG. 9, a plastic container 80 that is constructed according to another embodiment of the invention includes a bottom portion 82 and a main body portion 84 having a plastic sidewall 86 that is connected to the bottom portion 82. Plastic container 80 further includes an upper rim 88 that is constructed and arranged to be attached to a metal lid using a conventional double seaming process. The metal lid may be identical to the lid member 30 that is described above with reference to the first embodiment of the invention.

The main body portion 84 of the plastic container 80 advantageously is contoured so that the sidewall 86 includes a convex lower sidewall portion 90 and a concave upper sidewall portion 92. The inclusion of complex and multiple curvatures within the sidewall 86 can be used to increase the structural rigidity and strength of the main body portion 84, increase grippability of the container 80 by a consumer and provide a product that is more aesthetically attractive to the consumer than a cylindrical container.

The sidewall 86 also preferably includes a plurality of first sidewall portions 94 and a plurality of second sidewall portions 96, each of which is interposed between two adjacent first sidewall portions 94. The first sidewall portions 94 are each preferably constructed so that they have substantially smooth circumferentially extending outer surfaces 95 that are substantially flat, except for a slight curvature in order to conform to the general shape of the convex lower sidewall portion 90 are the concave upper sidewall portion 92. The smooth outer surfaces 95 preferably extend about an entire circumference of the main body portion 84.

The main body portion 84 is also preferably shaped so that it is substantially symmetrical about a longitudinal axis 98.

Each of the second sidewall portions 96 is preferably shaped to define a plurality of circumferentially spaced indentations 100, which are preferably substantially identical in shape and proportion to the circumferentially spaced indentations that have been described above with reference to the first embodiment of the invention. Each of the second sidewall portions 96 preferably extends about an entire circumference of the main body portion 84. The circumferentially spaced indentations 100 are preferably spaced substantially evenly about the entire circumference of the main body portion 84. Preferably, although not necessarily, there are an even number of the circumferentially spaced indentations 100 within each of the second sidewall portions 96.

Referring again to FIG. 9, it will be seen that each of the second sidewall portions 96 further includes a plurality of substantially vertical columns or beams 102, with each of the vertical columns or beams 102 being interposed between two adjacent ones of the circumferentially spaced indentations 100. The substantially vertical columns or beams 102 have the effect of providing additional column strength to the main body portion 84.

As FIG. 9 shows, the circumferentially spaced indentations 100 and columns 102 of adjacent second sidewall portions 96 are preferably staggered or rotationally displaced with respect to each other so that each of the vertical columns 102 is substantially centered with respect to one of the indentations 100 in the adjacent second sidewall portion 96. The staggering of the vertical columns 102 maintains the high column strength that is imparted by the columns 102, while increasing the overall hoop and shear strengths of the main body portion 84.

While both embodiments of the invention depicted herein show the first sidewall portion and the second sidewall portion extending about an entire periphery of the plastic container, it should be understood that the first and second sidewall portions could be provided on a limited portion of a plastic container that does not extend about the entire periphery or the entire vertical extent of the container. For example, the structural reinforcement that is provided by the juxtaposition of the first and second sidewall portions could be targeted toward a portion of a plastic container that has been determined to need such reinforcement.

In addition, while both of the embodiments of the invention that have been described above show both the first and second sidewall portions as having a substantially horizontal orientation, it should be understood that the principle of this aspect of the invention could be applied by arranging the first and/or second sidewall portions in an orientation that is not substantially horizontal. For example, the first and second sidewall portions could be arranged so that they extend helically over the outer surface of the container, or so as to extend substantially vertically, parallel to the longitudinal axis of the container.

Figure 10:
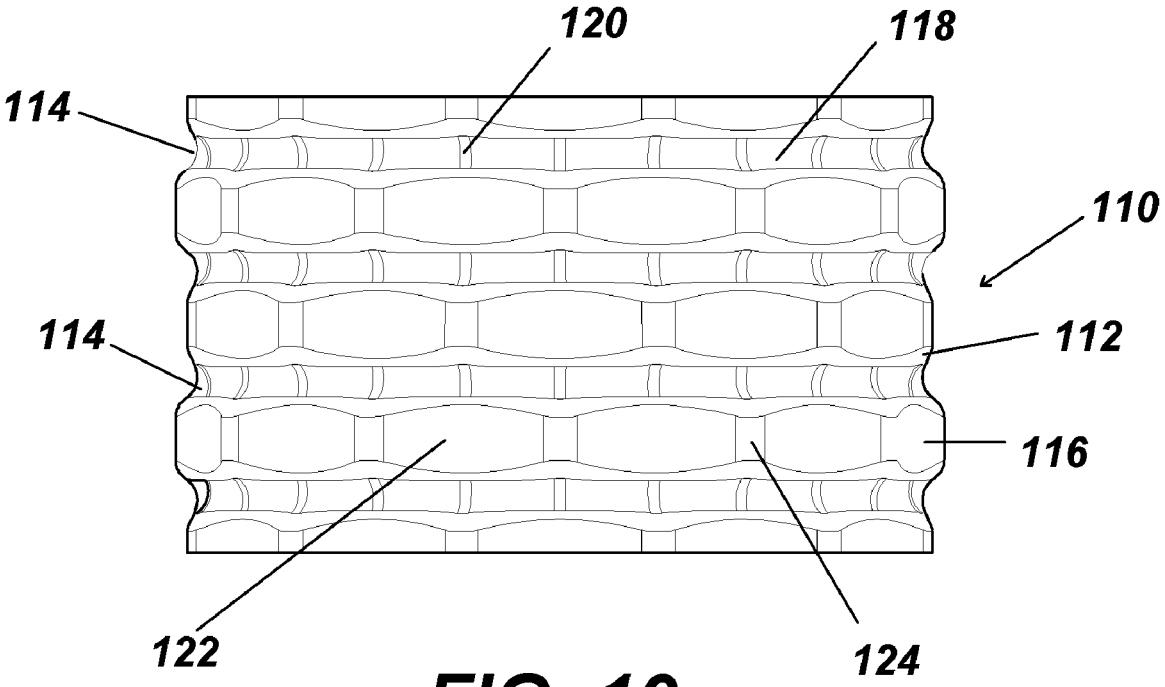
FIG. 10 is a side elevational view depicting a plastic container that is constructed according to a third embodiment of the invention.

A plastic container 110 that is constructed according to a third embodiment of the invention is depicted in FIG. 10. Plastic container 110 includes a sidewall 112 that is configured to include a plurality of first sidewall portions 114 and a plurality of second sidewall portions 116, each of which is interposed between two adjacent of the first sidewall portions 114. Both the first sidewall portions 114 and the second sidewall portions 116 preferably extend circumferentially all the way around the outer perimeter of the container 110 and are disposed so as to be substantially parallel to a transverse plane.

The first sidewall portions 114 preferably include a plurality of smooth, concave sidewall portions 118 that are separated from each other by a corresponding plurality of substantially vertical posts 120. Container 110 accordingly lacks the substantially smooth, flat first sidewall portions that were present in the previously described embodiments.

The second sidewall portions 116 are preferably constructed so as to be substantially identical to the second sidewall portions described above with respect to the other embodiments of the invention, and include a plurality of depressions 122 and a corresponding plurality of vertical posts 124.

Alternatively, the first sidewall portions 114 could be constructed so as to be substantially identical to the second sidewall portions 116.

The use of plastic material to fabricate the can body offers a number of potential advantages, such as lower energy costs during both the manufacturing and recycling stages, better formability and less susceptibility to denting during handling in comparison to metal cans. It also reduces the potential for contamination that can lead to conditions such as botulism.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a bottom portion; and a main body portion having a plastic sidewall that is connected to the bottom portion, the main body portion having a reinforced sidewall area that comprises a plurality of first sidewall portions and a plurality of second sidewall portions that are respectively interposed between the first sidewall portions, wherein an entirety of each of the second sidewall portions is recessed with respect to the adjacent first sidewall portions and extends circumferentially about the main body portion, each of the second sidewall portions further being shaped to define a plurality of alternating indentations that are concave as viewed in transverse cross-section and convex projections.

2. A plastic container according to claim 1, wherein the plastic sidewall has a thickness that is substantially within a range of about 0.040 inch to about 0.065 inch.

3. A plastic container according to claim 1, wherein the plurality of alternating concave indentations comprises a plurality of circumferentially spaced concave indentations that have an hourglass appearance as viewed in side elevation.

4. A plastic container according to claim 1, wherein each of the first sidewall portions comprises a substantially flat circumferentially extending outer surface.

5. A plastic container according to claim 4, wherein the main body portion has a vertical longitudinal axis, and the substantially flat circumferentially extending outer surface extends within a horizontal plane that is perpendicular to the vertical longitudinal axis.

6. A plastic container according to claim 1, wherein the main body portion is substantially cylindrical in shape.

7. A plastic container according to claim 1, wherein each of the second sidewall portions extends about an entire circumference of the main body portion.

8. A plastic container according to claim 7, wherein the concave indentations are spaced substantially evenly about the entire circumference of the main body portion.

9. A plastic container according to claim 1, wherein the convex projections comprise a plurality of substantially vertical columns, each of the vertical columns being interposed between two adjacent concave indentations.

10. A plastic container according to claim 9, wherein each of the vertical columns has an outer surface that is convexly curved.

11. A plastic container according to claim 10, wherein the main body portion has a maximum outer diameter and the convexly curved outer surface of the vertical columns has a radius, and wherein a ratio of the radius to the maximum outer diameter is substantially within a range of about 0.0195 to about 0.15.

12. A plastic container according to claim 11, wherein the ratio of the radius to the maximum outer diameter is substantially within a range of about 0.03 to about 0.075.

13. A plastic container according to claim 3, wherein the main body portion has a maximum outer diameter and each of the indentations has a concave curvature as viewed in a horizontal plane that has a radius, and wherein a ratio of the radius to the maximum outer diameter is substantially within a range of about 0.25 to about 1.5.

14. A plastic container according to claim 13, wherein the ratio of the radius to the maximum outer diameter is substantially within a range of about 0.5 to about 1.0.

15. A plastic container according to claim 9, wherein adjacent second sidewall portions are oriented so that the substantially vertical columns are not aligned with each other.

16. A plastic container according to claim 15, wherein each of the substantially vertical columns on one of the second sidewall portions is substantially centered as viewed in side elevation with respect to an indentation on an adjacent one of the second sidewall portions.

17. A plastic container according to claim 3, wherein each of the indentations has a first side having a first vertical height, a second side having a second vertical height and a central portion having a minimum vertical height that is less than the first and second vertical heights.

18. A plastic container according to claim 3, wherein further comprising a fillet defined in the sidewall between the indentation and an adjacent one of the first sidewall portions.

19. A plastic container according to claim 18, wherein each of the second sidewall portions further comprises a plurality of substantially vertical columns, each of the vertical columns being interposed between two adjacent indentations, and wherein each of the vertical columns has a first end that is joined to the fillet.

20. A plastic container according to claim 18, wherein the main body portion has a maximum outer diameter and the fillet is concave as viewed in side elevation and has a radius, and wherein a ratio of the radius to the maximum outer diameter is substantially within a range of about 0.01 to about 0.05.

21. A plastic container according to claim 20, wherein the ratio of the radius to the maximum outer diameter is substantially within a range of about 0.02 to about 0.04.

22. A plastic container according to claim 2, wherein the main body portion is constructed and arranged to withstand a heat sterilization process.

23. A plastic container according to claim 22, wherein the sidewall has a thickness that is substantially within a range of about 0.045 inch to about 0.055 inch.

24. A plastic container according to claim 1, wherein the sidewall has a thickness that is substantially within a range of about 0.015 inch to about 0.065 inch.

25. A plastic container according to claim 24, wherein the sidewall has a thickness that is substantially within a range of about 0.020 inch to about 0.055 inch.

26. A plastic container, comprising a bottom portion; and a main body portion having a plastic sidewall that is connected to the bottom portion, wherein the sidewall includes a plurality of circumferentially extending first sidewall portions and a plurality of circumferentially extending second sidewall portions that are recessed with respect to adjacent first sidewall portions, each of the second sidewall portions being interposed between two adjacent first sidewall portions, and wherein each of the second sidewall portions includes a plurality of circumferentially spaced alternating-vertical columns that are convex when viewed in transverse cross-section and indentations that are concave when viewed in transverse cross-section, and wherein adjacent second sidewall portions are rotationally staggered with respect to each other so that the vertical columns on one second sidewall portion are not aligned with the vertical columns of an adjacent second sidewall portion.

27. A plastic container according to claim 26, wherein the horizontally circumferentially extending first sidewall portions comprise a substantially flat outer surface.

28. A plastic container according to claim 26, wherein the main body portion is substantially cylindrical in shape.

29. A plastic container according to claim 26, wherein each of the circumferentially spaced indentations has an hourglass shape when viewed in side elevation.

30. A plastic container according to claim 29, wherein the circumferentially spaced indentations are spaced substantially evenly about the entire circumference of the main body portion.

31. A plastic container according to claim 26, wherein each of the vertical columns has an outer surface that is convexly curved.

32. A plastic container according to claim 31, wherein the main body portion has a maximum outer diameter and the convexly curved outer surface of the vertical columns has a radius, and wherein a ratio of the radius to the maximum outer diameter is substantially within a range of about 0.0195 to about 0.15.

33. A plastic container according to claim 32, wherein the ratio of the radius to the maximum outer diameter is substantially within a range of about 0.03 to about 0.075.

34. A plastic container according to claim 29, wherein the main body portion has a maximum outer diameter and each of the indentations has a concave curvature as viewed in a horizontal plane that has a radius, and wherein a ratio of the radius to the maximum outer diameter is substantially within a range of about 0.25 to about 1.5.

35. A plastic container according to claim 34, wherein the ratio of the radius to the maximum outer diameter is substantially within a range of about 0.5 to about 1.0.

36. A plastic container according to claim 26, wherein each of the substantially vertical columns on one of the second sidewall portions is substantially centered as viewed in side elevation with respect to a space between two adjacent substantially vertical columns on an adjacent one of the second sidewall portions.

37. A plastic container according to claim 26, wherein further comprising a fillet defined in the sidewall within the second sidewall portion adjacent to an interface with an adjacent one of the first sidewall portions.

38. A plastic container according to claim 37, wherein each of the vertical columns has a first end that is joined to the fillet.

39. A plastic container according to claim 37, wherein the main body portion has a maximum outer diameter and the fillet is concave as viewed in side elevation and has a radius, and wherein a ratio of the radius to the maximum outer diameter is substantially within a range of about 0.01 to about 0.05.

40. A plastic container according to claim 39, wherein the ratio of the radius to the maximum outer diameter is substantially within a range of about 0.02 to about 0.04.

41. A plastic container according to claim 26, wherein the main body portion is constructed and arranged to withstand a heat sterilization process, and wherein the sidewall has a thickness that is substantially within a range of about 0.040 inch to about 0.065 inch.

42. A plastic container according to claim 41, wherein the sidewall has a thickness that is substantially within a range of about 0.045 inch to about 0.055 inch.

43. A plastic container according to claim 26, wherein the sidewall has a thickness that is substantially within a range of about 0.015 inch to about 0.065 inch.

44. A plastic container according to claim 43, wherein the sidewall has a thickness that is substantially within a range of about 0.020 inch to about 0.055 inch.

* * * * *